United States Patent [19]

Sibeni

[11] Patent Number: 5,007,619

[45] Date of Patent: Apr. 16, 1991

[54] CHAIN LINK FENCE

[76] Inventor: Aldo Sibeni, 10 Executive Dr., Manhasset Hills, N.Y. 11040

[21] Appl. No.: 297,182

[22] Filed: Jan. 13, 1989

[51] Int. Cl.[5] ..... B21F 27/00

[52] U.S. Cl. ..... 256/34; 256/35; 256/22; 245/11

[58] Field of Search ..... 256/34, 35, 66, 65, 256/22; 403/252; 245/11

[56] References Cited

U.S. PATENT DOCUMENTS

| | | | |
|---|---|---|---|
| 79,854 | 7/1868 | Patterson . | |
| 603,938 | 5/1898 | Brock . | |
| 1,852,910 | 4/1932 | Williams et al. . | |
| 2,760,759 | 8/1956 | Rice | 256/34 |
| 3,212,754 | 10/1965 | Revell et al. | 256/22 |
| 3,355,150 | 11/1967 | Taylor | 256/34 |
| 3,356,343 | 12/1967 | Taylor | 256/34 |
| 3,822,053 | 7/1974 | Daily | 256/65 X |
| 3,958,794 | 5/1976 | Suprunuk et al. | 21/27 |
| 4,390,164 | 6/1983 | Cokelekoglu | 256/65 |
| 4,725,044 | 2/1988 | Cluff | 21/27 |
| 4,860,998 | 8/1989 | Snyder | 256/34 |

*Primary Examiner*—Andrew V. Kundrat
*Attorney, Agent, or Firm*—Weingram & Zall

[57] ABSTRACT

A chain link fence assembly is provided. This assembly includes a chain link wire fencing, a bottom horizontal channel, and a top horizontal channel. The assembly also includes a plurality of slats, which have lock tabs at the bottom ends thereof. The bottom channel has a web, which has a plurality of spaced cutouts, that receive the respective lock tabs. Each slat, which can be a vertical slat or a diagonal slat, has a central tubular portion, a left edge fin portion and a right edge fin portion. The lock tab, which is an extension of the slat tubular portion, has opposite edge recesses, which receive the opposite edges of its cutout, and has opposite projections, which hook behind the opposite edges of its cutout.

22 Claims, 4 Drawing Sheets

CHAIN LINK FENCE

BACKGROUND OF THE INVENTION

1. Field of the Invention

The invention relates to a chain link fence, and in particular the invention relates to a chain link fence having interwoven slats with respective lock tabs and having a bottom horizontal member with respective tab holes.

2. Prior Art

A prior art chain link fence is described in U.S. Pat. No. 4,725,044, to Cluff. Other related prior art patents include U.S. Pat. Nos.

3,958,794, to Suprunuk, et al., 3,356,343, to Taylor, 3,355,150, to Taylor. 1,852,910, to Williams, et al., 603,938, Brock, and 79,854, to Patterson.

Prior art, U.S. Pat. Nos. 4,725,044 to Cluff describes a prior art chain link fence assembly which includes a chain link wire fencing, a plurality of spaced slats which are interwoven in the chain link wire fencing, and which have respective tab holes, a bottom horizontal member which has a plurality of tab holes, and a plurality of lock strips, each having a top end lock tab and each having a bottom end lock tab for connection to the respective tab holes.

Prior art U.S. Patent Number 3,958,794 to Suprunuk. et al., describes a chain link fence assembly which includes chain link wire fencing, a plurality of vertical slats which are interwoven in the chain link wire fencing, with each slat having a bent portion engaging an adjacent portion of the chain link wire fencing.

Prior art U.S. Patent Number 3,356,343 to Taylor describes a chain link fence assembly which includes chain link wire fencing, a first plurality of diagonal slats disposed along one face of the chain link wire fencing, a second plurality of diagonal slats disposed over the first plurality of diagonal slats, each slat of the first and second pluralities of slats having a bent portion near the middle thereof engaging the chain link wire fencing.

Prior art U.S. Pat. No. 3,355,150 to Taylor describes a chain link fence assembly which includes chain link wire fencing, a first plurality of diagonal slats disposed along one face of the chain link wire fencing, a second plurality of oppositely slanted diagonal slats disposed over the first plurality of diagonal slats, each slat of the first and second pluralities of slats having a bent tab portion near the end thereof engaging the chain link wire fencing.

Prior art U.S. Pat. No. 1,852,910 to Williams. et al., describes a fence assembly which includes a pair of horizontally spaced fence posts, a plurality of pairs of twisted, horizontally disposed, vertically spaced wires, and a plurality of vertically disposed, horizontally spaced slats connected to the plurality of pairs of wires, each slat being disposed between the wires of each pair of wires.

Prior art U.S. Pat. No. 603,938 to Brock describes a fence panel. Such panel includes a pair of horizontally disposed, top and bottom stringers, a plurality of horizontally spaced, vertically disposed stays, and a plurality of vertically spaced, horizontally disposed wires, connected by clips to the stays.

Prior art U.S. Pat. No. 79,854 to Patterson describes a fence. Such fence includes two horizontally spaced fence posts, two pairs of twisted wires connected at their end portions to the respective fence posts, and a plurality of vertical slats each slat having four grooves respectively receiving the four wires of the two pairs of wires.

One problem with the prior art chain link fence assemblies is that the lock strips become disengaged from the tab holes connected thereto whereby the lock strips become separated from the fence assembly, and are lost.

SUMMARY OF THE INVENTION

According to the present invention, a chain link fence assembly is provided. This assembly includes chain link wire fencing, a plurality of spaced slats which are interwoven in the chain link wire fencing, each slat having an end with an integral lock tab, and a horizontal member, which has spaced tab holes which respectively receive the lock tabs.

By using the slats having an end portion with respective integral lock tabs, a lock tab cannot be separated from the fence, and the loss of a lock tab is avoided.

The foregoing and other objects, features and advantages will be apparent from the following description of the preferred embodiment of the invention as illustrated in the accompanying drawings.

DESCRIPTION OF THE PREFERRED EMBODIMENT

Figure 1:
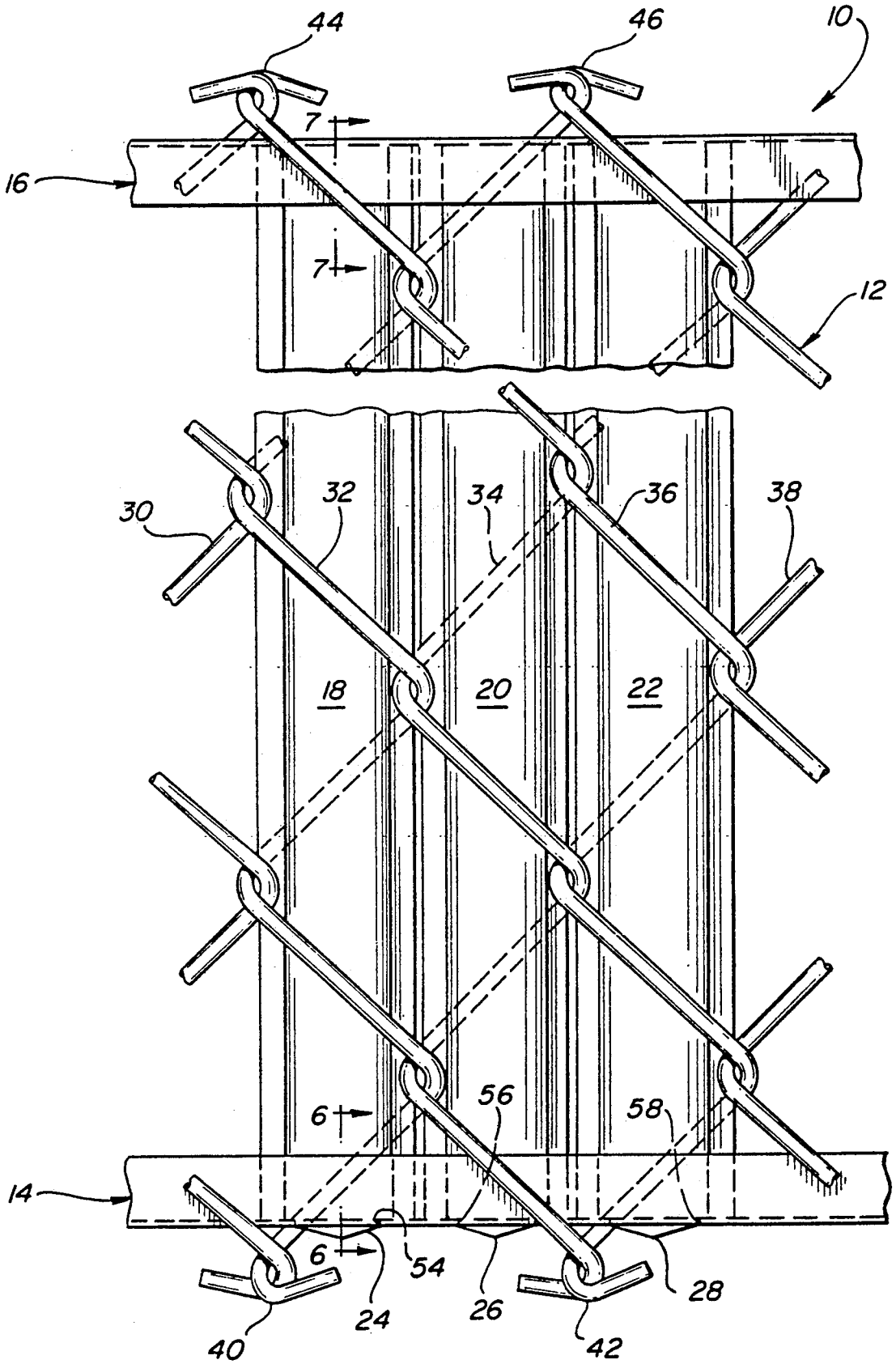
FIG. 1 is an elevation view of a fence assembly according to the present invention.

As shown in FIG. 1, a chain link fence assembly 10 is provided. Assembly 10 includes chain link wire fencing 12, a bottom channel or bottom member 14, and a top channel or top member 16. Assembly 10 has a plurality of slats or privacy strips 18, 20, 22, which have respective lock tabs 24, 26, 28, that lock into bottom channel 14.

Wire fencing 12 has a plurality of strands 30, 32, 34, 36, 38. Adjacent pairs of strands 30,32 and 34,36 have bottom connections or barbs 40,42 and have respective top connections 44,46.

Figure 2:
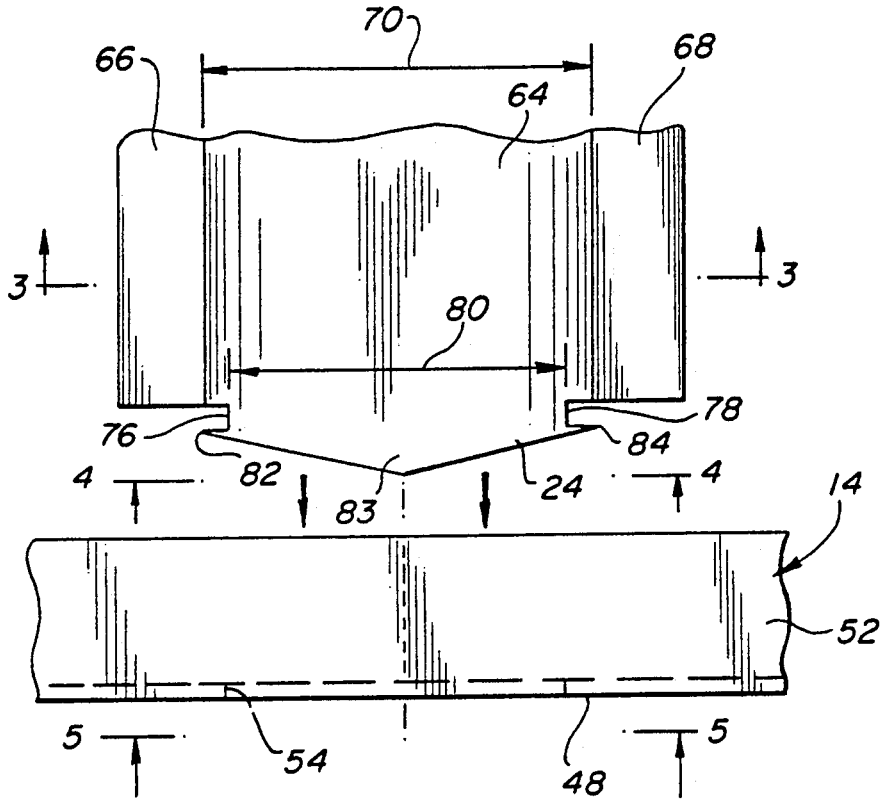
FIG. 2 is an enlarged disassembled view of a portion of FIG. 1.
Figure 5:
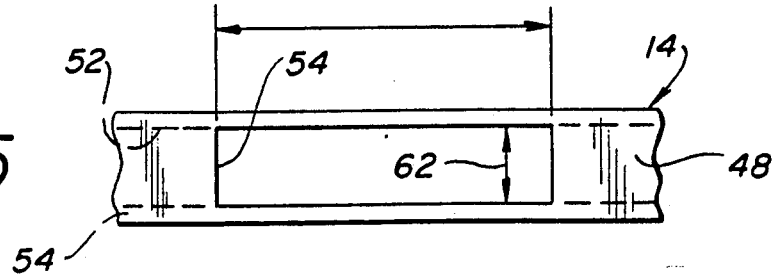
FIG. 5 is a section view as taken along line 5—5 of FIG. 2.
Figure 6:
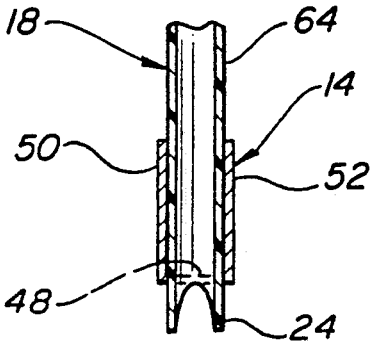
FIG. 6 is a section view taken along line 6—6 of FIG. 1.

As shown in FIGS. 2 and 5, bottom channel 14 has a web 48, a far flange 50 and a near flange 52. Web 48 has a plurality of cutouts 54, 56, 58 which receive respective tabs 24, 26, 28. (See FIG. 1).

As shown in FIG. 5, cutout 54, which is identical to cutouts 56,58, has an inside width 60 and an inside dimension 62, normal to width 60.

Figure 3:
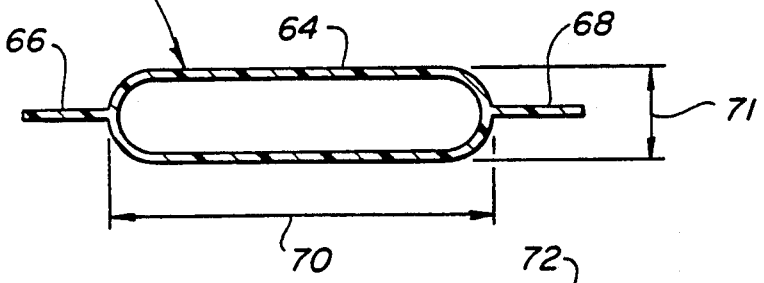
FIG. 3 is a section view taken along line 3—3 of FIG. 2.
Figure 4:
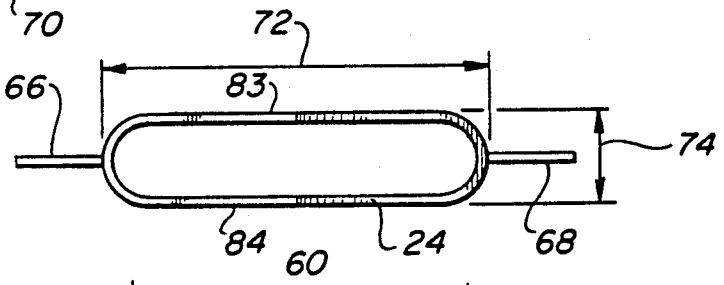
FIG. 4 is a view taken along line 4—4 of FIG. 2.

As shown in FIGS. 2, 3 and 4, slat 18, which is identical to slats 20,22, has a tubular portion 64, a left fin portion 66 and a right fin portion 68. Tubular portion 64 has an outside width 70 and an outside thickness 71.

As shown in FIG. 4, lock tab 24, which is identical to lock tabs 26,28 has an outer width 72, which is equal to width 70, and has an outer thickness 74, which is equal to thickness 71. Lock tab 24 has a left recess 76 and a right recess 78. Recesses 76 and 78 have an outer width 80 disposed therebetween. Recess width 80 is slightly less than cutout width 60. Thickness 74 of lock tab 24 is slightly less than cutout dimension 62.

Lock tab 24 has a left projecting portion 82 and has a right projecting portion 84. Portions 82,84 are flexible and deformable portions in order that tab portion 24 can be inserted into recess 54. Portions 82,84 lock tab portion 24 into bottom channel 14.

Figure 7:
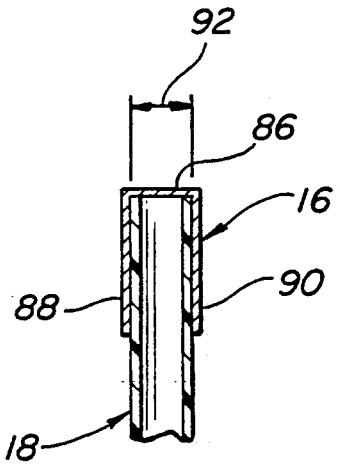
FIG. 7 is a section view taken along line 7—7 of FIG. 1.
Figure 10:
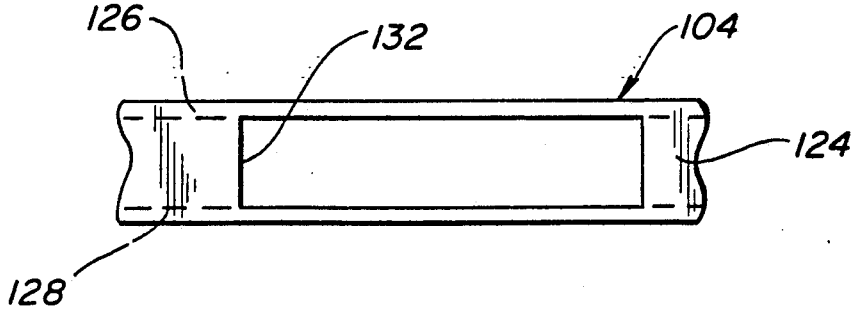
FIG. 10 is a view taken along line 10—10 of FIG. 9.

As shown in FIG. 7, top channel 16 has a web 86, a far flange 88 and a near flange 90. Flanges 88,90 have an inner dimension 92 therebetween. Dimension 92 is slightly larger than tubular portion thickness 71.

Fencing 12 is preferably composed of a metal material. Slats 18, 20, 22 are preferably composed of a plastic material. Bottom channel 14 and top channel 16 are preferably composed of a plastic, or metal material.

Channel 14 and 16 are structural members. Bottom channel 14 helps to support slats 18, 20, 22. Slats 18, 20, 22 receive some friction forces from wires 30, 32, 34, 36, 38, if slats 18, 20, 22 are bowed or are subject of a wind load. Such friction forces help to support slats 18, 20, 22 on the wires. Channels 14, 16 take a transverse bending moment when a wind load is applied to slats 18, 20, 22 and wires 30, 32, 34, 36, 38. When the channels 14,16 are suitable designed, the transverse loads from the wind force can be transmitted by the channels 14,16 to the fence posts (not shown), as desired.

Projecting portions 82,84 are arcuate pieces. Lock tab 24 is an extension of tubular portion 64. Lock tab 24 has a near wall portion 83 and a far wall portion 85. The two arcuate projecting portions 82,84 can be cut in order to form four separate projections, if desired.

Figure 8:
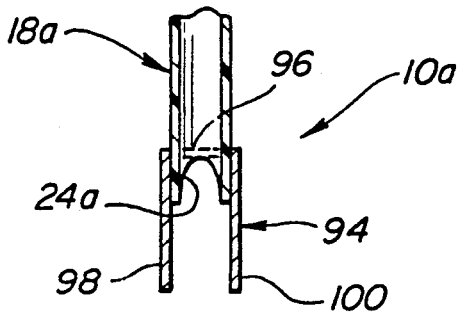
FIG. 8 is a second embodiment of a fence assembly portion corresponding to FIG. 6.

A second embodiment of part of assembly 10*a* is shown in FIG. 8. Parts of assembly 10*a*, which are the same as corresponding parts of assembly 10, have the same numerals, but with a subscript "*a*" added thereto. Assembly 10*a* has a bottom channel 94, which has a web 96, a far flange 98 and a near flange 100. Flanges 88,90 face downwardly. Channel 94 has a cutout (not shown) which receives lock tab 24*a*.

Figure 9:
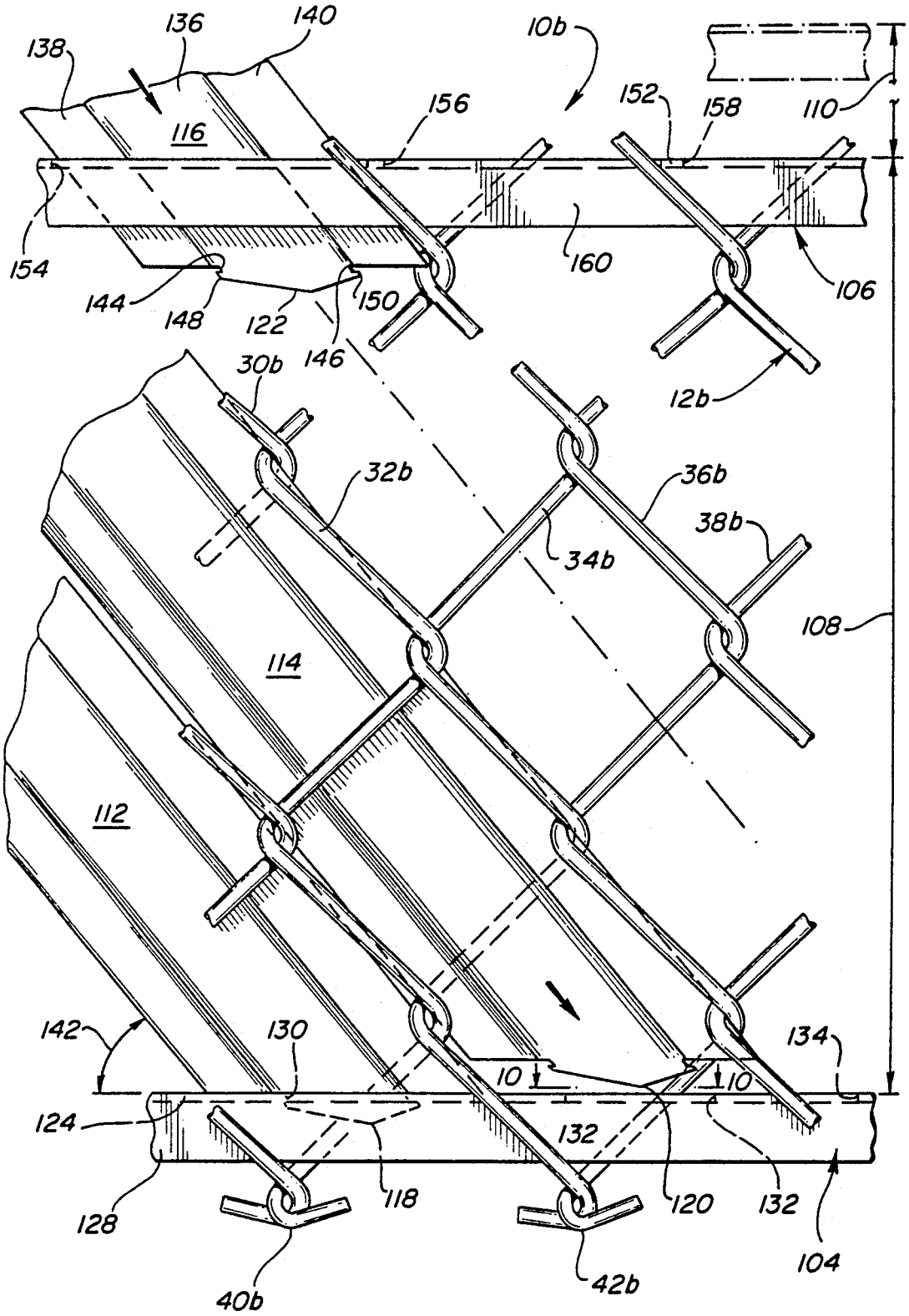
FIG. 9 is an elevation view of a third embodiment of a fence assembly corresponding to FIG. 1.

A third embodiment of assembly 10*b* is shown in FIG. 9. Parts of assembly 10*b* which are the same as corresponding parts of assembly 10, have the same numerals, but with a subscript "b" added thereto. Assembly 10*b* has a fencing 12*b*, a bottom channel 104, a top channel 16*b* and a median channel 106. Median channel 106 is located at a distance 108 from bottom channel 104 and is located at an equal distance 110 from top channel 16*b*. Assembly 10*b* has a plurality of slats 112, 114, 116 which have respective lock tabs 118, 120, 122.

Fencing 12*b* has wire strands 32*b*, 34*b*, 36*b*, 38*b*, which have bottom connections 40*b*, 42*b*. Bottom channel 104 has a bottom web 124 and a far flange 126 and a near flange 128. Web 124 has cutouts 130, 132, 134. Slat 116, Which is a typical slat, has a tubular portion 136, a left fin 138 and a right fin 140. Each slat 112, 114, 116 is disposed at an angle 142, which is about 45 degrees. Cutout 132 has an inner width, which measures about 1.41 times the size of the width of the tubular portion 136 as measured along a line that is normal to its fin edge.

Lock tab 122 has a left recess 144, a right recess 146, a left projecting portion 148, and a right projecting portion 150. Median channel 106 has a web 152, which has cutouts 154, 156, 158 and has a far flange (not shown) and a near flange 160.

The process of constructing assembly 10 is indicated hereafter.

A. Chain fencing 12 is stretched and connected to suitable fence posts (not shown).

B. Bottom channel 14 is inserted horizontally between the wires 30, 32, 34, 36, 38 just above the bottom connections 40, 42.

C. Slats 18, 20, 22 are inserted vertically in the spaces between respective wires 32, 34, 36.

D. Lock tabs 24, 26, 28 are inserted vertically into respective cutouts 54, 56, 58. Lock tabs 24, 26, 28 are then held in place by their respective projecting portions, such as portions 82,84 of lock tab 24.

E. Top channel 16 is then inserted horizontally in the spaces between wires 30, 32, 34, 36, 38 adjacent to top connections 44,46. Top channel 16 is supported on the top ends of slats 18, 20, 22, which are supported on bottom channel 14.

The process of constructing assembly 10*b* is the same as the process of constructing assembly 10, except that slats 112, 114, 116 are inserted diagonally in the spaces between respective wires 30*b*, 32*b*, 34*b*, 36*b*, 38*b* and except that median channel 106 is inserted just after the bottom channel 104 is inserted and before the slats 112, 114, 116 are inserted through the wires and the median channel 106.

While the invention has been described in its preferred embodiment, it is to be understood that the words which have been used are words of description rather than limitation and that changes may be made within the purview of the appended claims without departing from the true scope and spirit of the invention in its broader aspects.

The embodiments of an invention in which an exclusive property or right is claimed are defined as follows:

1. A chain link fence assembly, comprising: chain link fencing;

a bottom horizontal member engaged by the fencing;

a top horizontal member engaged by the fencing;

a plurality of horizontally spaced slats extending through spaces between the wires and connecting to the bottom horizontal member and engaging the top horizontal member;

the slats having respective lock tabs formed therein and integral therewith projecting outwardly from the bottom ends thereof, said bottom horizontal member having a plurality of horizontally spaced cutouts respectively receiving the horizontally spaced lock tabs;

wherein each lock tab has a pair of opposite recesses disposed on opposite edges thereof, the recesses forming a pair of opposite projecting portions, the projecting portions being flexible for insertion of the lock tab into its respective cutout and being resilient for returning to its original shape after insertion into the cutout in order to lock the slat into the respective connecting cutout of the bottom horizontal member.

2. A chain link fence assembly comprising: chain link fencing;

a bottom horizontal member engaged by the fencing;

a top horizontal member engaged by the fencing;

a plurality of hhorizontally spaced slats extending through spaces between the wires and connecting to the bottom horizontal member and engaging the top horizontal member, the slats having an elongate central tubular portion, and first and second elongate edge fin portions, the tubular portion being disposed between the fin portions and being integral therewith;

the slats having respective lock tabs integral therewith and projecting outwardly from the bottom ends thereof;

the bottom horizontal member having a plurality of horizontally spaced cutouts respectively receiving the horizontally spaced lock tabs.

3. A chain link fence comprising: chain link fencing;

a bottom horizontal member engaged by the fencing;

a top horizontal member engaged by the fencing;

a plurality of horizontally spaced slats extending through spaces between the wires and connecting to the bottom horizontal member engaging the top horizontal member, wherein the slats include an elongate slat tubular portion having a tab tubular portion projecting outwardly from the bottom ends thereof from the slat tubular portion, the tab tubular portion having front and rear tab wall portions, each tab ball portion having a pair off opposite recess portions and having a pair of opposite projecting portions forming respective lock tabs integral with the tab tubular portion;

the bottom horizontal member having a plurality of horizontally spaced cutouts respectively receiving the horizontally spaced lock tabs.

4. The chain link fence assembly of claim 1, 2, or 3 including a median horizontal channel disposed between the bottom horizontal member and the top horizontal member, said median horizontal member having a plurality of horizontally spaced cutouts respectively receiving the slats.

5. The chain link fence assembly of claim 1, 2 or 3 wherein the slats are diagonal slats disposed at a selected angle to the horizontal bottom member.

6. The chain link fence assembly of claim 2, wherein each lock tab has a pair of opposite recesses disposed on opposite edges thereof, the recesses forming a pair of opposite projecting portions, the projecting portions being flexible for insertion of a lock tab into its respective cutout and being resilient for returning to its original shape after insertion into the cutout in order to lock the slat into the respective connecting cutout of the bottom horizontal member.

7. The chain link fence assembly of claim 1, 2 or 3, wherein each of the horizontal members has a channel shape and has a web and has a pair of flanges.

8. The chain link fence assembly of claim 7, wherein the flanges of the top horizontal member point downwardly and the flanges of the bottom horizontal member point upwardly, for gripping the opposite ends of each slat.

9. The chain link fence assembly of claim 1 wherein each slat has an elongate central tubular portion, and first and second elongate edge fin portions, the tubular portion being disposed between the fin portions and being integral therewith.

10. The chain link fence assembly of claim 3, wherein the elongate tubular portion is disposed between and integral with first and second elongate edge fin portions.

11. The chain link fence assembly of claim 2 wherein the lock tab has a tubular portion extending from the slat tubular portion, said lock tab tubular portion having front and rear tab wall portions, each tab wall portion having a pair of opposite recess portions and having a pair of opposite projecting portions.

12. The process of constructing a chain link fence assembly including the steps of:

installing chain link wire fencing between supports;

providing a first shaped member having a plurality of spaced cutouts in a web thereof;

passing the first shaped member between wires in the wire fencing near the bottom edge of the wire fencing;

providing a plurality of slats having at least one lock tab formed therein and integral therewith, each tab projecting outwardly from the bottom end of the slat and having a pair of opposite recesses disposed on opposite edges thereof, thee recesses forming a pair of opposite projecting portions, the projecting portions being flexible for insertion of the lock tab into its respective cutout and being resilient for returning to its original shape after insertion in the cutout in order to lock the slat into the respective connecting cutout of the bottom horizontal member; and passing the slats in a downward direction between wires in the wire fencing to lock the lock tabs into the cutouts in the first shaped member.

13. The process of claim 12, further comprising passing a second shaped member between wires in the wire fencing near the top edge of the wire fencing and overlapping the slats.

14. A chain link fence subassembly comprising:

a bottom horizontal member;

a top horizontal member;

a plurality of horizontally spaced slats connecting to the bottom horizontal member and engaging the top horizontal member;

the slats having respective lock tabs formed therein and integral therewith projecting outwardly from the bottom ends thereof;

the bottom horizontal member having a plurality of horizontally spaced cutouts respectively receiving the horizontally spaced lock tabs;

wherein each lock tab has a pair of opposite recesses disposed on opposite edges thereof, the recesses forming a pair of opposite projecting portions, the projecting portions being flexible for insertion of the lock tab into its respective cutout and being resilient for returning to its original shape after insertion n the cutout in order to lock the slat into the respective connecting cutout of the bottom horizontal member.

15. A chain link fence subassembly comprising:

a bottom horizontal member;

a top horizontal member;

a plurality of horizontally spaced slats connecting to the bottom horizontal member and engaging the top horizontal member, the slats having an elongate central tubular portion, and first and second elongate edge fin portions, said tubular portion being disposed between the finn portions and being integral therewith;

the slats having respective lock tabs integral therewith and projecting outwardly from the bottom ends thereof;

the bottom horizontal member having a plurality of horizontally spaced cutouts respectively receiving the horizontally spaced lock tabs.

16. A chain link fence subassembly comprising:

a bottom horizontal member;

a top horizontal member;

a plurality of horizontally spaced slats connecting to the bottom horizontal member and engaging the top horizontal member:

the slats having an elongate slat tubular portion having a tab tubular portion projecting outwardly from the bottom ends thereof, the tab tubular portion having front and rear tab wall portions, each tab wall portion having a pair of opposite recess portions and having a pair of opposite projecting portions forming respective lock tabs integral with the tab tubular portion;

the bottom horizontal member having a plurality of horizontally spaced cutouts respectively receiving the horizontally spaced lock tabs.

17. A slat subassembly for a chain link fence comprising:

a horizontal member;

at least one slat connecting to the horizontal member;

said slat having lock tabs forming therein and integral therewith projecting outwardly from the bottom end thereof, wherein each lock tab has a pair of opposite recesses disposed on opposite edges thereof, the recesses forming a pair of opposite projecting portions, the projecting portions being flexible for insertion of the lock tab into a cutout in the horizontal member and being resilient for returning to its original shape after insertion into the cutout n order to lock the slat into the respective connecting cutout of the horizontal member.

18. A slat subassembly for a chain link fence comprising:

a horizontal member;

at least one slat extending connecting to the horizontal member;

the slat having an elongate central tubular portion, first and second elongate edge fin portions, the tubular portion being disposed between the fin portions and being integral therewith;

the slat having respective lock tabs integral therewith and projecting outwardly from the bottom end thereof;

the horizontal member having a cutout for receiving the lock tabs.

19. A slat subassembly for a chain link fence comprising:

a horizontal member;

at least on slat connecting to the horizontal member;

wherein each slat has an elongate central slat tubular portion;

the slat having a tubular tab portion projecting outwardly from the bottom end thereof from the slat tubular portion, the tab tubular portion having front and rear wall portions, each tab wall portion having a pair of opposite recess portions and having a pair of opposite projecting portions forming respective lock tabs integral with the tab portion;

the horizontal member having cutouts for receiving the lock tabs.

20. A slat member for a chain link fence comprising:

an elongate central tubular portion;

a first elongate edge fin portion;

a second elongate edge fin portion;

the elongate central portion being disposed between the first and second elongate edge fin portion and being integral therewith;

a lock tab extending from the central tubular portion;

the lock tab having a tab tubular portion;

the tab tubular portion having front and rear tab wall portions;

each tab wall portion having a pair of opposite recess portions and having a pair of opposite projecting portions.

21. A slat member for a chain link fence comprising:

an elongate tubular portion;

a lock tab extending from the tubular portion;

the lock tab having a tab tubular portion;

the tab tubular portion having front and rear tab wall portions;

each said tab wall portion having a pair of opposite recess portions and having a pair of opposite projecting portions.

22. A slat member for a chain link fence comprising:

an elongate portion having lock tabs formed therein and integral therewith projecting outwardly from one end thereof, wherein each lock tab has a pair of opposite recesses disposed on opposite edges thereof, the recesses forming a pair of opposite projecting portions, the projecting portions being flexible and resilient.

* * * * *